United States Patent [19]

Walters

[11] 4,016,616

[45] Apr. 12, 1977

[54] DIVER FLOTATION APPARATUS

[75] Inventor: William D. Walters, Costa Mesa, Calif.

[73] Assignee: Lawrence S. Scott, Seal Beach, Calif.

[22] Filed: June 12, 1975

[21] Appl. No.: 586,505

Related U.S. Application Data

[63] Continuation of Ser. No. 295,508, Oct. 6, 1972, abandoned, which is a continuation-in-part of Ser. No. 152,112, June 11, 1971, abandoned.

[52] U.S. Cl. ..... 9/339; 61/69 R; 114/16 E

[51] Int. Cl.[2] ..... B63C 11/30

[58] Field of Search ..... 114/16 A, 16 E; 115/6.1; 9/301, 311, 313, 336, 339; 61/69 R, 69 A, 70, 71; 128/142.2, 142.4

[56] References Cited

UNITED STATES PATENTS

| | | | |
|---|---|---|---|
| 2,864,101 | 12/1958 | Kissenberger | 9/339 |
| 2,982,105 | 5/1961 | Akers | 61/70 |
| 3,379,023 | 4/1968 | Crose | 61/70 |
| 3,436,777 | 4/1969 | Greenwood | 9/313 |
| 3,487,647 | 1/1970 | Brecht, Jr. | 114/16 E |
| 3,670,509 | 6/1972 | Walters | 61/69 R |
| 3,820,348 | 6/1974 | Fast | 114/16 E |

*Primary Examiner*—Trygve M. Blix
*Assistant Examiner*—Stuart M. Goldstein
*Attorney, Agent, or Firm*—Fulwider Patton Rieber Lee & Utecht

[57] ABSTRACT

Diver flotation apparatus including buoyancy compensation apparatus in the back pack over the diver's back, and including an inflatable portion connected to the diver's air supply through a diver operated valve for filling the inflatable portion to achieve buoyancy compensation. The back pack incorporates internal weights, the amount and character of which can be changed to adjust the center of gravity of the diver and equipment. This allows a diver to easily adjust and maintain an optimum buoyancy and attitude relative to the water surface.

6 Claims, 19 Drawing Figures

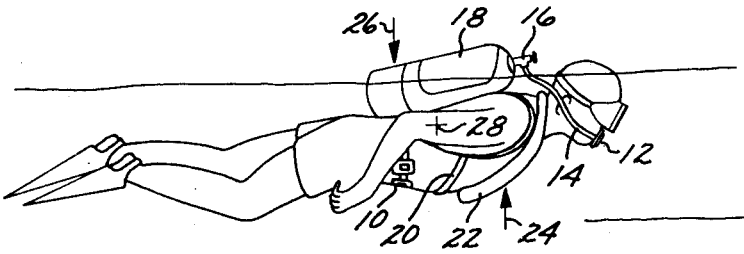
FIG.1
FIG.2
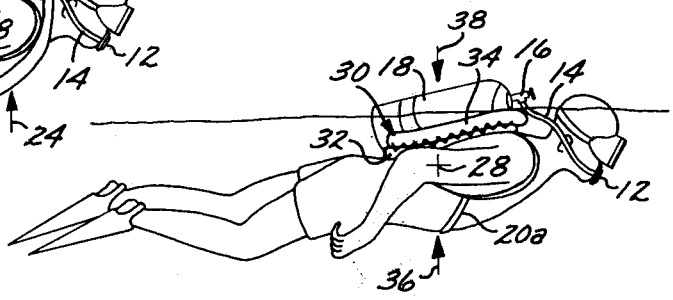
FIG.3
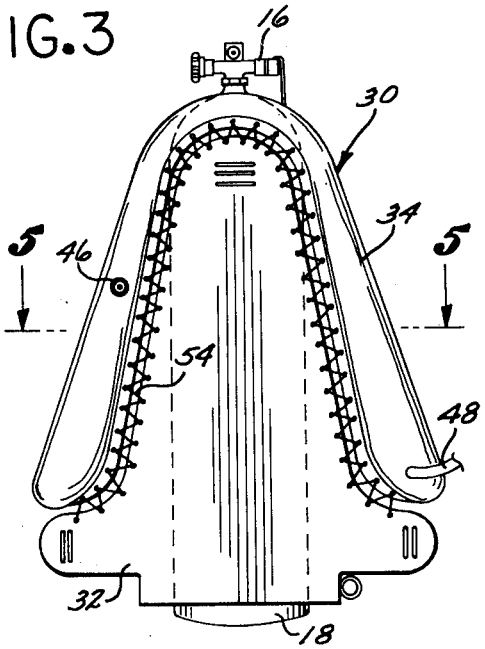
FIG.4
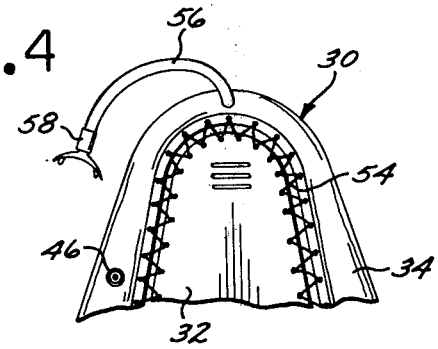
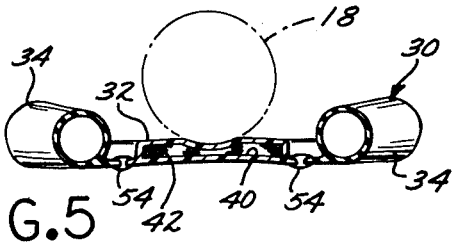
FIG.5
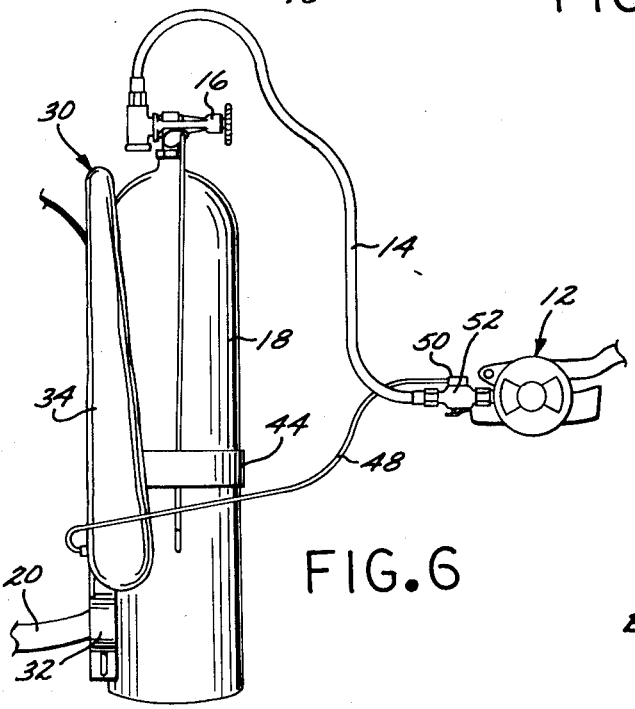
FIG.6
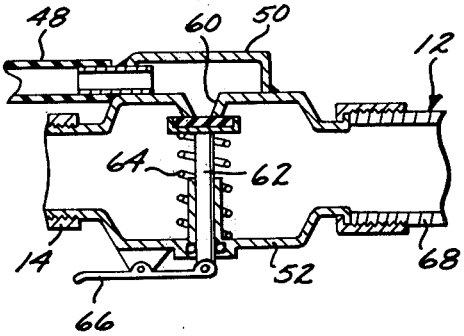
FIG.7
INVENTOR
WILLIAM D. WALTERS
BY Fulwider, Patton, Rieber, Lee and Utecht
ATTORNEYS FIG.13
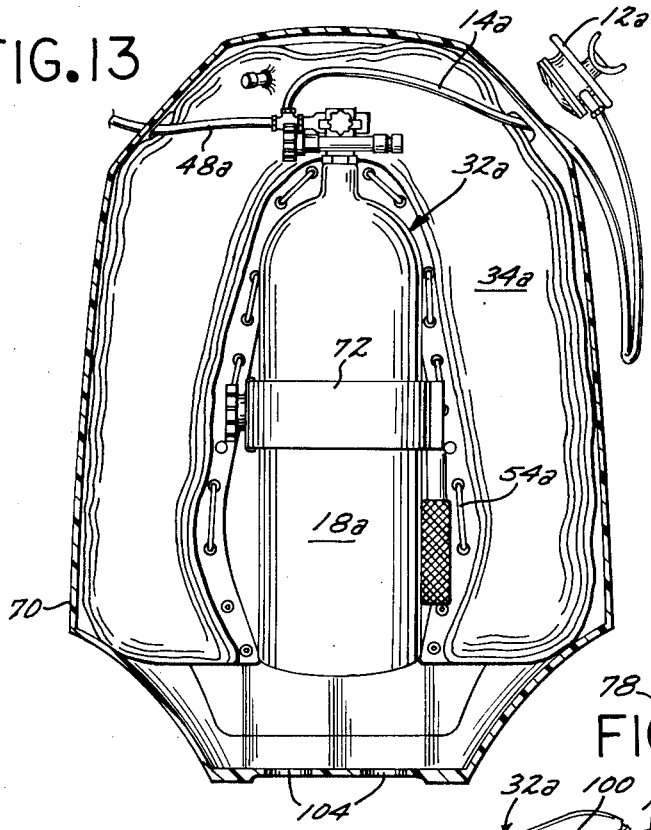
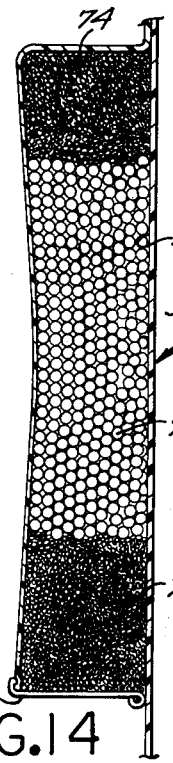
FIG.14
FIG.15
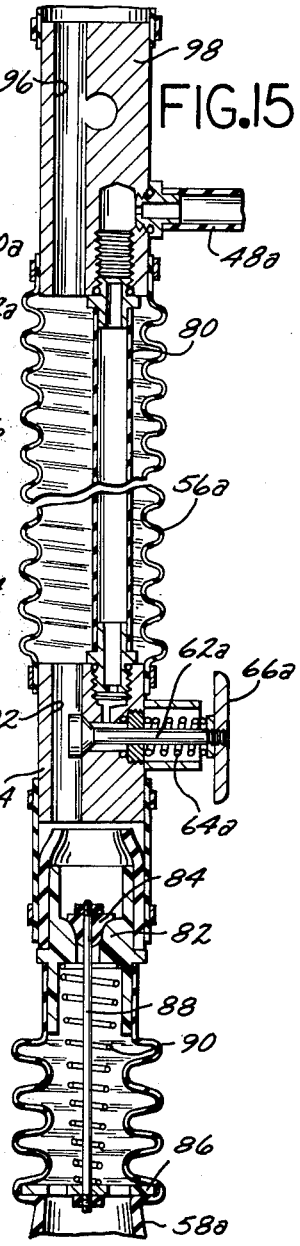
FIG.16
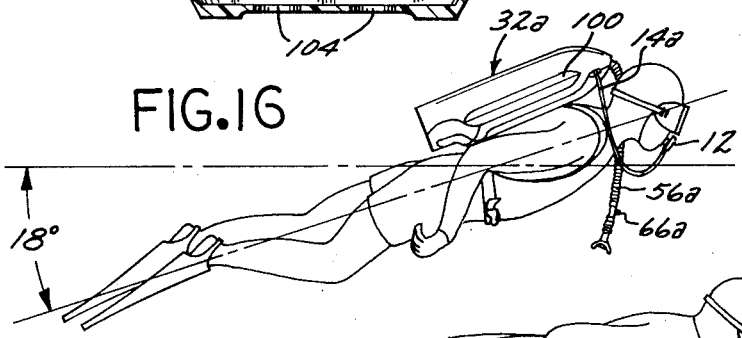
FIG.17
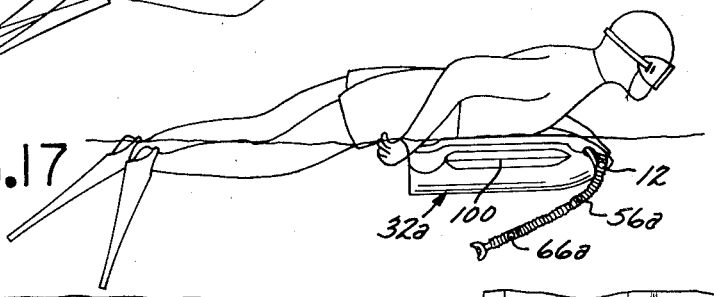
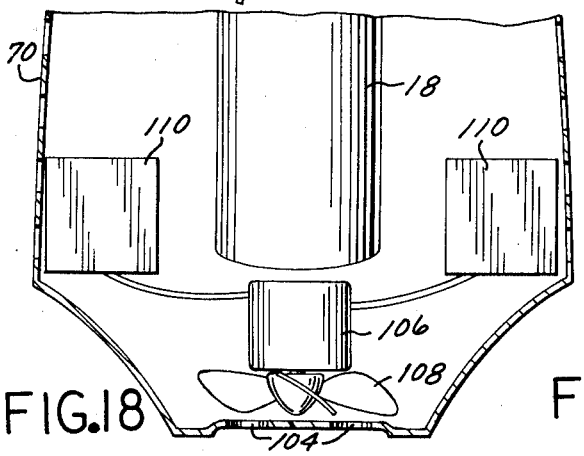
FIG.18
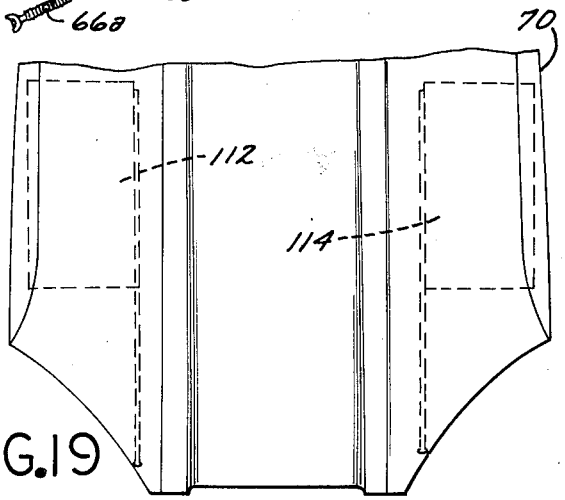
FIG.19

DIVER FLOTATION APPARATUS

CROSS-REFERENCE TO RELATED APPLICATION

This application is a continuation of my copending application Ser. No. 295,508, filed Oct. 6, 1972, and entitled "Diver Flotation Apparatus" which is a continuation-in-part of my non abandoned application Ser. No. 152,112, filed June 11, 1971 and entitled "Buoyancy Compensation Means," and priority of said applications Ser. Nos. 152,112 and 295,508 is claimed under 35 U.S.C. 120.

BACKGROUND OF THE INVENTION

1. Field of the Invention:

The present invention relates to a diver flotation apparatus and more particularly to such an apparatus incorporated in the back pack of a diver.

2. Description of the Prior Art:

A SCUBA (self-contained underwater breathing apparatus) diver usually wears a back pack strapped to his person to provide a means for supporting an air tank or tanks, a weight belt about his waist to overcome his natural positive buoyancy, and a life vest inflatable to provide buoyancy compensation. Another form of back pack dispenses with the need for a weight belt by incorporating weights as an integral part of the back pack. One such type of back pack is described in my U.S. Pat. No. 3,670,509, issued June 20, 1972, and entitled "Buoyancy Adjustment Back Pack."

Although a life vest is useful to float the diver on the surface in an emergency, and is useful to a limited extent in helping the diver to reach the surface, it is primiarily useful in adjusting the buoyancy of the diver during a dive. That is, it is not always possible to accurately predict the amount of weight a diver must wear to achieve neutral or slightly positive buoyancy, so the life vest is mouth inflated underwater in an amount sufficient to establish the desired buoyancy. Undesired negative buoyancy occurs for various reasons, such as a weight gain by the diver since his last dive; too many lead weights in his belt or back pack; or compression of the foam cells in his wet suit at diving depths.

Like all equipment which the diver must wear, the life vest impairs his freedom of movement, is a bother to put on and take off, its filling tube sometimes becomes entangled in other equipment and is difficult to quickly locate, the vest is relatively expensive, and care must be exercised to keep it from becoming partially filled with water during inflation underwater. Moreover, the position of the life vest under the diver's body, across his waist and chest, provides poor hydrodynamic stability, particularly where a weight belt is used. The diver is so oriented by the locations of the various pieces of equipment that he tends to be buffeted by surface waves, particularly when swimming through surf.

SUMMARY

According to the present invention a diver flotation apparatus or buoyancy compensation means is provided as an integral part of the back pack of a diver. It provides the buoyancy adjustment functions of the usual inflatable safety or life vest. The back pack includes weights which are adjustable in location so as to enable adjustment of the overall center of gravity of the diver and his equipment relative to his center of buoyancy. This in turn establishes his attitude in the water, which is particularly important when he is on the water surface. With proper adjustment there is little tendency for the diver's trunk and legs to pivot downwardly and forwardly in the water, as is usually the case. Instead, a generally horizontal attitude is established, with the preferred attitude of the diver's body with respect to the water surface being an angle of about 18°. This makes it relatively easy for the diver to negotiate surf when swimming to or from deeper water.

The present flotation apparatus includes a container or bag which is preferably flexibly laced to the margins of the back pack to better accommodate rough wave action. In one embodiment this wave action is resisted by a protective casing or shell disposed about the bag. A filling means is included to supply air to the chamber formed by the bag, the air being provided either orally by the diver, or by air tapped off the diver's air tank or the like. Preferably the diver's second stage demand regulator is used as the air supply. A diver operable valve is provided to enable the diver to control the flow of air from his second stage regulator to the air bag chamber or buoyancy compensator.

With this arrangement the overall buoyancy of the diver and his equipment is adjusted by simply tapping his air supply through a valve, without any necessity for a life vest or mouth inflation of such a life vest underwater.

The preferred combination of the air bag or buoyancy compensator with a back pack incorporating integral weights provides a single piece of equipment which is easily donned by the diver. The usual separate weight belt and separate life vest with their multiplicity of straps are completely eliminated.

In a preferred embodiment of the present diver flotation apparatus the integral weights are preferably pelleted or otherwise divided into small units so that they can be distributed according to the physical characteristics of the individual diver. The back pack is formed with a hollow chamber which is elongated along the axis of the diver's body and the pelleted mass is distributed along the length of this chamber to establish the preferred attitude of the diver's body relative to the water surface. In a typical situation in which, for example, 20 pounds of weight are necessary, six pounds of lead shot would be located in the lower portion of the chamber, three pounds in the upper portion of the chamber, with the remaining weight intermixed with a pelleted mass of near-neutral buoyancy, such as glass marbles or the like.

The protective facing or shell utilized in the preferred embodiment of the present apparatus substantially completely surrounds the other components of the apparatus to minimize water drag and provide hydrodynamic stability. This is particularly advantageous in negotiating surf or rough water. The shell can be utilized under proper conditions to ride incoming waves in a manner like that of a conventional surfboard.

Other objects and features of the invention will become apparent from consideration of the following description taken in connection with the accompanying drawings.

BRIEF DESCRIPTION OF THE DRAWINGS

FIG. 1 is a side elevational view of a diver wearing a conventional weight belt and life vest;

FIG. 2 is a side elevational view of a diver wearing a diver flotation apparatus according to the present invention, in combination with a back pack utilizing integral weights;

FIG. 3 is a front elevational view of the compensator and back pack of FIG. 2;

FIG. 4 is a partial view of a second embodiment similar to that of FIG. 3, but including an emergency compensation inflation and deflation system;

FIG. 5 is a view taken along the line 5—5 of FIG. 3;

FIG. 6 is a side elevational view of the compensator and back pack of FIG. 2, including the second stage demand regulator;

FIG. 7 is a partial longitudinal cross sectional view of the fitting connecting the compensator and the second stage demand regulator;

FIG. 13 is a longitudinal cross sectional view of the apparatus of FIG. 8, viewed from the rear;

FIG. 14 is an enlarged longitudinal cross sectional view of the weight chamber defined by the back pack;

FIG. 15 is an enlarged cross sectional view of the filler hose for inflating the vest or bag portion of the apparatus of FIG. 8;

FIG. 16 is a side elevational view of a diver wearing the apparatus of FIG. 8, and illustrating the angle of the diver's body relative to the water surface;

FIG. 17 is a similar side elevational view of the diver, but illustrating the diver utilizing the apparatus of FIG. 8 as a support platform beneath his body;

FIG. 18 is a longitudinal cross sectional view of the lower portion of the apparatus of FIG. 8, diagrammatically illustrating the manner in which a motor and batteries can be fitted within the outer shell to provide diver propulsion; and FIG. 19 is a view similar to FIG. 18, and diagrammatically illustrating the manner in which a radio transmitter and receiver can be fitted within the outer shell.

DESCRIPTION OF THE PREFERRED EMBODIMENT

Figure 8:
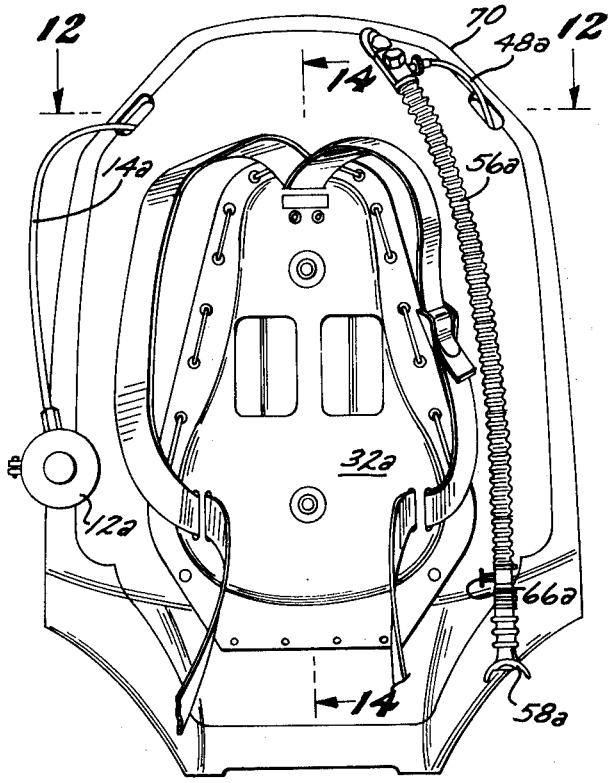
FIG. 8 is a front elevational view of a second embodiment of a diver flotation apparatus according to the present invention, including weights whose character and location can be adjusted for the individual diver, and including an outer facing or shell.
Figure 9:
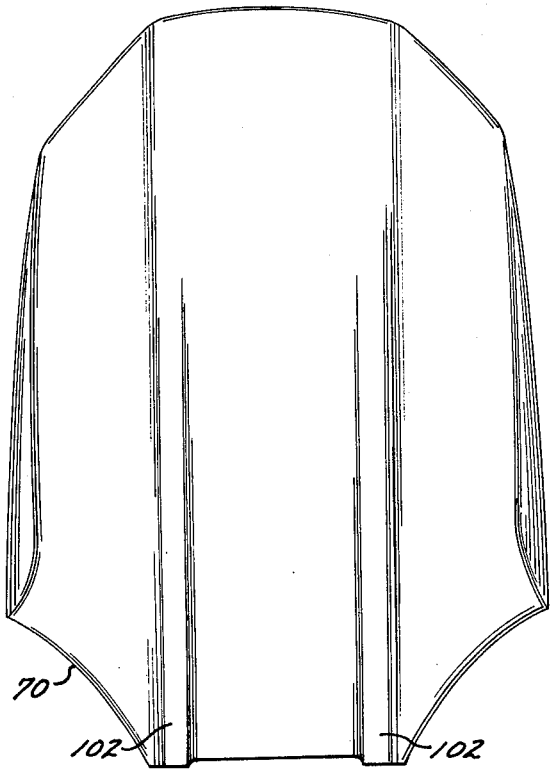
FIG. 9 is a rear elevational view of the apparatus of FIG. 8.

Referring to FIG. 1, there is illustrated a typical prior art assembly of equipment worn by a SCUBA diver. In addition to the usual face mask and swim fins, he wears a weight belt 10 about his waist, and breathes through a second stage air regulator 12 connected by an air hose 14 to a first stage regulator 16 mounted to the top of an elongated, generally cylindrical air tank 18 constituting the air supply. The tank 18 is strapped or otherwise mounted by a harness 20 to the diver's body. In addition, an inflatable safety vest 22 is fitted to the diver with the inflatable portion of the vest located generally cross his chest.

With this arrangement the positive buoyancy imparted to the diver by the inflated vest 22 acts upwardly, as generally indicated by the arrow 24, while the weight of the belt 10 and tank 18 act in a downward direction generally indicated by the arrow 26. This couple acts about the approximate center of gravity 28 of the diver so that his legs tend always to sink downwardly, placing the diver in a generally vertical position. A diver usually prefers to maintain a horizontal attitude to better scan the ocean bottom, and to facilitate swimming on the surface, and it is fatiquing to have to continually kick to maintain the desired horizontal attitude.

Another disadvantage of the prior art type of equipment just described is the difficulty of swimming through surf while towing or pushing the back pack and tank. The tank and pack ride low in the water, the uninflated life vest is of little use, and the heavy weight belt is a burden.

FIG. 2 illustrates a diver flotation apparatus, buoyancy compensation means or compensator 30 according to the present invention and comprising, generally, a vertically elongated pack structure 32 supporting the usual air tank 18, configured to fit upon the back of a diver, and including a harness 20*a* for mounting the pack structure 32 to the diver's body. The compensator 30 also comprises an air fillable container means in the form of a flexible air bag 34 which is inflatable for adjustment of the overall buoyancy of the diver and his equipment.

Although the compensator 30 may include a usual prior art back pack, it preferably includes a pack structure 32 of the type described in my U.S. Pat. No. 3,670,509. This type of structure includes integral weights and greatly improves the weight distribution of the equipment relative to the diver. With such a structure the general direction of the boyant force provided by the inflated air bag 34 is indicated by the arrow 36, while the arrow 38 indicates the general downward direction assumed by the air tank 18 and the weights in the pack structure 32. The arrows 36 and 38 are in substantial vertical alignment with one another and with the approximate center of gravity 28 of the diver. This places the equipment weight across the diver's back where he is best able to bear it and locates the buoyant force of the air bag so that this weight is largely balanced. In addition, the air bag is in a better position to stabilize the diver in rough water when it is on his back.

Actual diver use demonstrates that this weight distribution enables the diver to better negotiate rough water and wave action, the longitudinal axis of his body being oriented at an angle of approximately 18 degrees relative to the water surface. Also, the integrated character or one-piece nature of the assembled compensator 30 and tank 18 permits the diver to easily push or pull the equipment through the water and therefore don it underwater in a single over-the-head movement.

Referring now to FIGS. 3–6, the pack structure 32 is hollow, defining a compartment 40 generaly coextensive with the structure 32 and containing weights 42 in the form of lead shot, all as more particularly described in my U.S. Pat. No. 3,670,509.

The pack structure 32 supports the tank 18 by means of a metal tank strap 44 and is contoured to the shape of the diver's back, extending from the small of the back to the hip region. The structure 32 widens in a downward direction so that it is wide enough at the waist to accommodate the harness waist straps and yet is small enough not to be cumbersome. However, a principal feature of the structure 32 is the integral incorporation of the weights 42, which eliminates any need for the prior art weight belt 10.

The container means or air bag 34 has a generally inverted U-shape and is hermetically sealed except for a safety valve 46 operative to prevent over-inflation of the air bag 34, and except for a filling means or hose 48 extending between the air bag chamber 40 and a fitting 50 which is soldered or otherwise secured to the top of a valve housing 52.

The air bag 34 is preferably made of flexible material such as canvas or synthetic fabric impregnated with a suitable air tight, water proof material. The interior margin of the bag 34 terminates in a flange provided with a plurality of openings to receive a lacing 54, which is also disposed through complemental openings provided in the outer edge margin of the pack structure 32, as best seen in FIG. 3.

The flexible material of the air bag 34 and the flexible character of the lacing connection permits the bag 34 to accommodate itself to rough wave action without being damaged or torn away from the back pack proper. When inflated it rides the waves much like a small boat. It can be made to hold a much greater volume of air than the prior art vest because it is up out of the way on the diver's back, as compared with the vest which is worn in front.

Another form of air bag 34 is illustrated in FIG. 4. It includes an emergency filling hose 56 opening at one end into the air bag 34, and fitted at its other end with a flexible mouthpiece 58. The hose incorporates a flexible valve (not shown) which can be operated by the diver to enable him to inflate the bag 34 through the mouthpiece 58, or to allow air to escape from the bag.

In the preferred arrangement the air hose 48 is always used to fill the air bag 34. This hose, as best seen in FIG. 7, opens into the hollow interior of the fitting 50 which, in turn, is in communication with the hollow interior of the housing 52 through a port 60. The port 60 is normally closed by the head of a valve 62 acting under the bias of a compression spring 64 which is disposed about the valve stem. The lower end of the valve stem passes through an opening in the lower wall of the housing 52, an O-ring being disposed in the margin of the opening to provide a fluid tight fit.

The lower end of the valve stem is pivotally connected to one extremity of an actuating lever 66, which is pivoted at its mid portion to the housing 52. Pressing upon the free end of the lever 66 unseats the valve 62, as will be apparent.

One open end of the housing 52 is threadedly connected to the air hose 14 coming from the first stage regulator 16, while the opposite open end of the housing 52 is threadedly connected to a conduit 68. This conduit is connected to the second stage regulator 12, which is fitted with a mouthpiece so that it can be carried in the diver's mouth for breathing purposes. If a double hose regulator arrangement is used, the housing 52 would still be connected to the second stage, but would be located at the juncture of the two hoses.

Air normally passes from the air supply through the hose 14 on diver demand, flowing around the valve 62, through the housing 52, and through the conduit 68 to the regulator 12. Whenever the diver actuates the lever 66 to lift the valve 62 off its seat, some of this air is tapped or bled off through the hose 48 and passes to the air bag 34. By regulating the amount of this air passing to the bag 34, the diver can precisely control his buoyancy as he wishes. If he completely inflates the bag 34 to the point where air begins to come out of the safety valve 46, the diver will tend to float close to the water surface, as shown in FIG. 2. If he adjusts the amount such that neutral buoyancy exists, he can maintain his position at any depth.

In operation, the bag 34 can be inflated and the one-piece combination of the tank 18, pack structure 32, bag 34, and associated regulators is capable of being floated on the water and pushing ahead of the diver as he swims out past the surf line. Therefore, it is a simple matter for the diver to don the equipment by ducking below the surface of the water and moving the equipment over his head and onto his back in a single sweeping motion upwardly and rearwardly. When ready to dive he can allow the air to escape from the bag 34 by squeezing an collapsing the flexible valve in the hose 56. If desired, any other suitable form of valve can be used for this purpose.

Thus, the present diver flotation apparatus provides a single assembly or structure which provides all of the functions previously provided by separate weight belts, life vests, back packs and the like. Moreover, by locating an inflatable air bag over the diver's back, the bag can be made relatively large to support considerably more weight than the prior art vest, the bag improves the angle of inclination of the diver's body in the water, and the bag tends to function like a small boat in rough water. In addition, utilization of second stage air, at a pressure of between 90 and 135 psi, to fill the air bag provides a rapid and efficient means for adjusting buoyancy without any possibility of inadvertent flooding of the air bag.

Referring now to FIGS. 8–13, there is illustrated another embodiment of the present diver flotation apparatus. The embodiment of FIGS. 8–17 is similar in many respects to the embodiment of FIGS. 1–7, differing primarily in the provision of weights which are capable of adjustment to establish for each individual diver the proper angle or attitude of the diver's body relative to the water surface. In addition, this embodiment includes a hydrodynamically efficient enclosure, casing, or cover 70. In most other respects the apparatus of FIGS. 13–17 is essentially the same as that of the embodiment of FIGS. 1–6. Where this similarity exists, the components of the embodiment of FIGS. 8–17 will be identified with the same numeral and the subscript *a*.

The present embodiment includes a vertically elongated pack structure **32*a* supporting an air tank 18*a* by means of a conventional tank band 72** which is fastened by a bolt and wing nut assembly (not shown) suitably fitted to the back pack for rigid attachment of the tank, as will be apparent to those skilled in the art.

The back pack **32*a* is preferbly made of molded plastic and includes molded-in slots or the like through which the harness 32*a*** is fitted.

The pack structure **32*a* is hollow, as best seen in FIG. 14, defining a compartment 40*a* about as wide as the diameter of the tank 18*a* and extending along the longitudinal axis of the diver's body. The compartment 40*a* contains weights of different specific gravity, pelleted lead shot 74 and glass marbles 76. The glass marbles are of course much less heavy, compared to the lead shot. The bottom of the chamber 40*a* is closed by a pivoted door 78 which can be quickly opened to jettison all or part of the weights, all as more particularly described in my U.S. Pat. No. 3,670,509. Since the structure of an exemplary door 78 is set forth in the aforesaid patent, a description of it will be omitted. However, it is important to note that the individual pellets 74 and 76** of different specific gravity make it possible to adjust the center of gravity of the diver and his equipment, to thereby establish an ideal diver attitude relative to the surface of the water. As previously indicated, an optimum diver attitude greatly enhances the ability of the diver to easily swim through rough water, and particularly through surf.

Typically the amount of weight needed by a diver amounts to ten percent of his body weight plus approximately three pounds. Thus, for a diver weighing 170 pounds, the weight needed amounts to 20 pounds. With reference to FIG. 14, it has been found that the upper portion of the compartment 40*a* should be filled with approximately three pounds of lead shot 74, the middle portion then being loaded with a mixture of glass marbles 76 and lead shot weighing approximately 11 pounds, with the remaining portion of the compartment being filled with lead shot 74 weighing six pounds. The shot 74 provides most of the weight, with the marbles 76 being provided to keep the weights from moving back and forth as the diver changes his attitude.

With the example given the attitude of the diver relative to the surface of the water should be approximately 18° in the average case. However, depending upon the diving requirements, the attitude of the diver relative to the water surface can be varied between approximately zero and 30° by simply changing the relative position of the lead shot in the compartment 40*a*. This attitude is best illustrated in FIG. 16. The diver simply chooses the weight location which makes it easiest for him to negotiate rough water. The total capacity of the compartment 40*a* is about 30 pounds.

The vest portion of air bag 34*a* is made of flexible material which is attached by a lacing 54*a* to the outer edge margin of the pack structure 32*a*, as best illustrated in FIG. 13.

As best seen in FIGS. 8, 13 and 15, the filling hose 56*a* is attached to and opens into the air bag 34*a*, and is fitted at its other end with a mouthpiece 58*a*. The hose 56*a* is actually a two conduit system, the inner conduit being defined by a hose 80 which extends from the area of a valve 62*a* adjacent the mouthpiece 58*a*, all the way up to a point in the hose 56*a* close to where it is attached to the bag 34*a*.

As best seen in FIG. 15, the mouthpiece end of the filling hose 56*a* includes an internal fitting 82 which defines a valve seat normally closed by a valve 84. An apertured plate 86 is also disposed within the hose 56*a*, but more closely adjacent to the mouthpiece 58*a*, and is connected to the valve 84 by an elongated bolt 88. Normally the valve 84 is seated to prevent air from passing through the central aperture of the fitting 82, and the valve 84 is maintained in this closed state by the bias of a compression spring 90 which acts at its opposite ends against the fittings 82 and 86. When the diver wishes to orally inflate the air bag 34*a*, he puts the mouthpiece 58*a* in his mouth and presses against it while holding the exterior of the hose 56*a*, to thereby compress the spring 90 and raise the valve 84 off its seat. The diver expelled air then passes upwardly through a vertical passage 92 in a fitting 94 also disposed within the filling hose 56*a*. From this point the air passes upwardly through the hose, through a through passage 96 in still another fitting 98 within the hose, and thence to the air bag 34*a*.

Air can be vented from the air bag 34*a* by simply pressing against the mouthpiece 58*a* to unseat the valve 84.

The air bag 34*a* can be filled with air from the tank 18*a* by means of a conduit 48*a* which is attached at one end to the first stage of the air regulator, as best seen in FIG. 13. The opposite end of the conduit 48*a* is threadably attached to the fitting 98, opening into a passage which is in communication with the interior of the hose 80, as best seen in FIG. 15. Thus, second stage air is always available at the hose 80. A valve 62*a* is slidably carried by the fitting 94, and is biased by a spring 64*a* to a position in which it closes the passage from the hose 80 through the fitting 94 to the passage 92 which is in communication with the filling hose 56*a* connected to the air bag 34*a*. Pressing upon a valve disc 66*a* causes the second stage air to pass through the hose 56*a* to the air bag 34*a* until the desired buoyancy is achieved, at which point the valve disc 66*a* is released for closure by the bias of the spring 64*a*.

Figure 10:
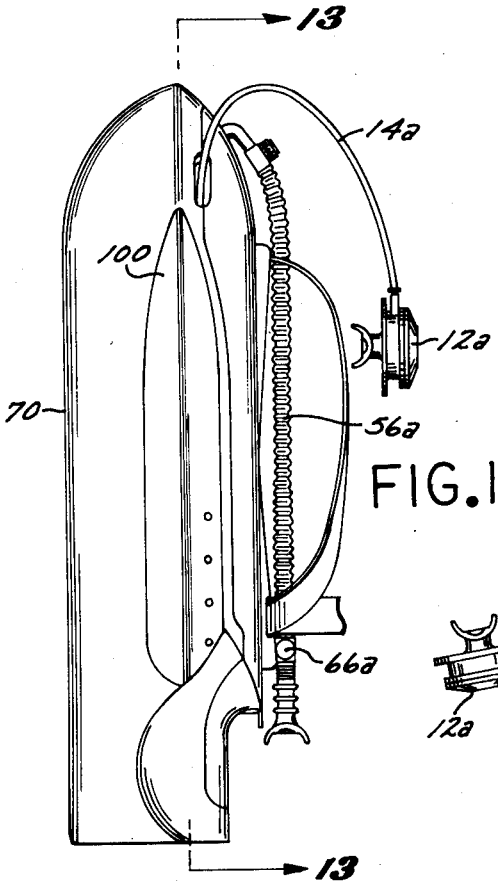
FIG. 10 is a side elevational view of the apparatus of FIG. 8.
Figure 11:
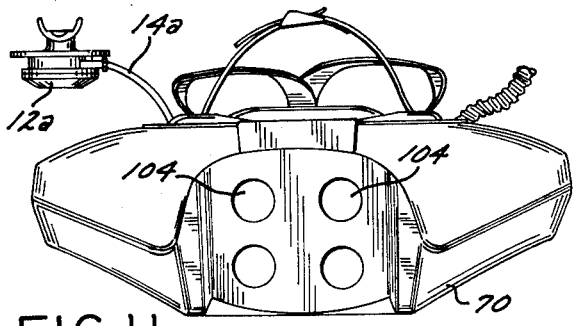
FIG. 11 is a bottom plan view of the apparatus of FIG. 8.
Figure 12:
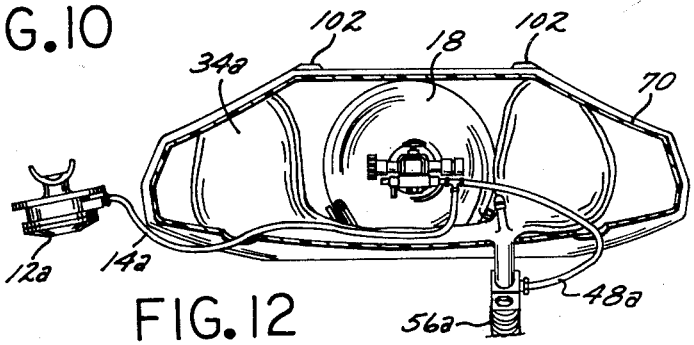
FIG. 12 is a top plan view of the apparatus of FIG. 8.

The cover 70 is designed to substantially encompass or cover all of the components of the diver flotation apparatus so as to minimize water drag and to protect the diver against equipment protuberances and the like. It preferably is made of molded plastic and is formed to include a pair of bullet-like side appendages or pontoons 100, as best seen in FIG. 10, and has molded in, axially extending runners or skids 102 which facilitate pulling of the equipment package across a sandy beach, for example. The configuration of the cover 70 is generally streamlined and faired to enclose the equipment and provide a space within which the air bag 34*a* can be expanded. The bottom of the cover 70 preferably includes a plurality of openings 104 through which water can drain. In addition, as best illustrated in FIG. 18, a motor 106 and attached propeller 108 can be suitably mounted in the lower portion of the cover 70 for propulsion, the motor being energized by a pair of batteries 110. As another example of equipment which can be carried within the cover 70, FIG. 19 illustrates diagrammatically how a radio receiver 112 and radio transmitter 114 can be carried within the hollow interior of the cover 70.

The configuration of the cover 70 is designed to not only make it easier for the diver to move through the water during a dive, but is also designed to enable the diver to use the assembly much like a surfboard in traveling through surf or other rough water, as best illustrated in FIG. 17.

In operation, the flotation apparatus of FIGS. 8–17 is extremely straightforward. The diver operates the valve 62*a* to inflate the bag 34*a* at the water's edge. He can then either don the apparatus, as seen in FIG. 16, to swim through the surf, or he can ride the equipment packgage through the surf, as best seen in FIG. 17, thereafter donning the equipment by an over-the-head motion while simultaneously slipping his arms through the harness staps.

When the diver reaches the diving area he depresses or inwardly pushes the mouthpiece 58*a* to allow air to escape from the air bag 34*a*. He then switches from snorkeling with the mouthpiece 58*a* to the regulator mouthpiece 12*a* and begins his dive. When the dedired depth is reached the diver can precisely adjust his buoyancy by operating the valve 62*a* to adjustably inflate the air bag 34*a*.

It is on the surface of the water that the advantages of the present apparatus are most apparent. The diver can swim through the water with much less effort because of reduced water resistance, and the angle or attitude provided by the apparatus floats the diver in a position in which he can breathe much easier. Between dives he can rest on the surface of the water in one of three different positions. He may breathe through his snorkel with his body inclined at approximately 18° relative to the water surface; he may lie on his back with the inflated air bag maintaining him almost completely out of the water; or he may take off the apparatus and use it as a surface float by lying upon it.

Various modifications and changes may be made with regard to the foregoing detailed description without departing from the spirit of the invention.

I claim:

1. Diver flotation apparatus comprising:

a back pack adapted to mount on air supply and including weight means forming an integral part of said back pack for imparting negative buoyancy to said back pack, said back pack including a longitudinally oriented compartment receiving said weight means, said weight means comprising discrete elements of at least two specific gravities completely filling said compartment so that they are incapable of shifting during a dive, said discrete elements being longitudinally redistributable in said compartment to adjust the location of the center of gravity of said weight means along the longitudinal axis of said compartment to thereby adjust the angular attitude of the diver relative to the water surface.

2. Apparatus according to claim 1 wherein said discrete elements are glass and lead.

3. Diver flotation apparatus comprising:

a back pack adapted to mount an air supply;

collapsible container means on said back pack and located over the back of the wearing diver, said container means defining a chamber for receiving air to both upwardly and downwardly adjust the overall buoyancy of the diver and his equipment, said container means being wholly disposed along the outer perimeter of said back pack;

flexible lacing securing said container means to said back pack thereby to enable relative movement between said container means and said back pack under wave action;

filling means on said back pack adapted to be coupled to said air supply and operative to apply air to said chamber, and including a valve operative by the diver to regulate the quantity of air passing from said air supply to said chamber; and venting means including a valve operative by the diver to vent air from said chamber to the outside environment to thereby adjust the positive buoyancy of the diver and his equipment.

4. Apparatus according to claim 3 wherein said filling means includes an air hose coupled to said chamber and adapted to be coupled to said air supply; and an oral inflator in said air hose for filling said chamber independently of said air supply.

5. Diver flotation apparatus comprising:

a mouthpiece demand regulator;

a back pack adapted to mount an air tank and regulator means for reducing tank pressure to a lower stage pressure for application to said demand regulator;

collapsible container means on said back pack and located over the back of the wearing diver, said container means defining a chamber for receiving said lower stage pressure air from said tank and said regulator means to both upwardly and downwardly adjust the overall buoyancy of the diver and his equipment;

filling means on said back pack coupled to said tank and said regulator means, to said chamber, and to said demand regulator, and operative to apply said lower stage air both to said chamber and to said demand regulator, and including a valve manually operative by the diver to regulate the quantity of said air passing from said air tank and said regulator means to said chamber; and venting means including a valve manually operative by the diver to vent air from said chamber to the outside environment to thereby adjust the positive buoyancy of the diver and his equipment.

6. Apparatus according to claim 5 wherein said filling means includes an oral inflator for filling said chamber independently of said tank and said regulator means.

* * * * *

UNITED STATES PATENT OFFICE

CERTIFICATE OF CORRECTION

Patent No. 4,016,616 Dated April 12, 1977

Inventor(s) William D. Walters

It is certified that error appears in the above-identified patent and that said Letters Patent are hereby corrected as shown below:

Column 1, line 8 delete "non" and insert --now--;

Column 4, line 32, delete "bovant" and insert --buoyant--;

and

Column 8, line 60 delete "dedired" and insert --deşired--.

Signed and Sealed this

*Sixth* Day of *September 197*

[SEAL]

*Attest:*

RUTH C. MASON
*Attesting Officer*

LUTRELLE F. PARKER
*Acting Commissioner of Patents and Trademarks*